US006146252A

United States Patent [19]

Mårtensson

[11] Patent Number: 6,146,252

[45] Date of Patent: Nov. 14, 2000

[54] METHOD OF MACHINING A THERMOSETTING LAMINATE

[75] Inventor: Göran Mårtensson, Klagstorp, Sweden

[73] Assignee: Perstorp Flooring AB, Trelleborg, Sweden

[21] Appl. No.: 09/051,042

[22] PCT Filed: Oct. 9, 1996

[86] PCT No.: PCT/SE96/01273

§ 371 Date: Jul. 14, 1998

§ 102(e) Date: Jul. 14, 1998

[87] PCT Pub. No.: WO97/13626

PCT Pub. Date: Apr. 17, 1997

[30] Foreign Application Priority Data

Oct. 10, 1995 [SE] Sweden ..... 9503515

[51] Int. Cl.[7] ..... B24B 9/20

[52] U.S. Cl. ..... 451/44; 264/162

[58] Field of Search ..... 451/165, 44, 28; 264/DIG. 31, 162, 139, 138

[56] References Cited

U.S. PATENT DOCUMENTS

| | | | |
|---|---|---|---|
| Re. 25,033 | 8/1961 | Balamuth | 451/28 |
| 3,223,056 | 12/1965 | Wilburn | 264/138 |
| 5,303,510 | 4/1994 | Calkins | 451/165 |
| 5,305,556 | 4/1994 | Kopp et al. . | |
| 5,318,420 | 6/1994 | Blaimschein | 264/138 |
| 5,474,488 | 12/1995 | Yamamoto et al. | 451/28 |

*Primary Examiner*—Robert A. Rose
*Attorney, Agent, or Firm*—Stevens, Davis, Miller & Mosher, L.L.P.

[57] ABSTRACT

Method of machining a thermosetting laminate (13) by means of an apparatus comprising at least one high-frequency or ultrasonic oscillation generator (1) and at least one dimension changing or adjusting unit (4) having at least one piezoelectric crystal (8) performing a linear vibration when charged with an alternating current. The linear vibration is propagated through at least one mechanical or electronic amplitude transforming unit (5), whereby generated high-frequency or ultra-sound amplitude is transformed into a linear vibration. The linear vibration is during machining propagated via at least one tiller or tool holder (7), being connected to the amplitude changing unit (5), to at least one tool (2) attached to the tiller or tool holder (7) and consisting of a least one diamond (3), whereby at least said tool (2) performs a linear vibrating movement (16) and whereby said tool (2) executes said machining.

26 Claims, 2 Drawing Sheets

METHOD OF MACHINING A THERMOSETTING LAMINATE

Figure 1:
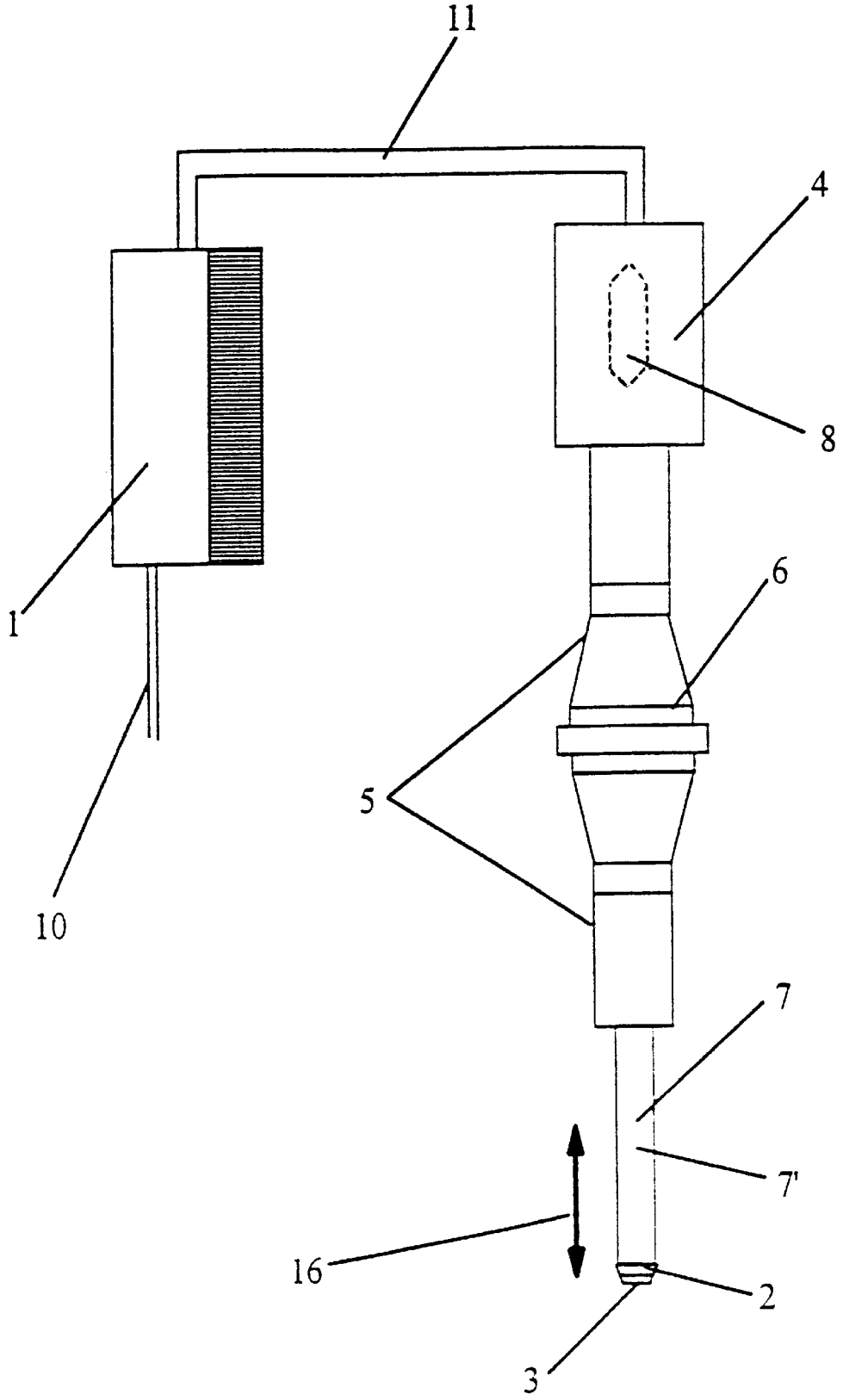

The present invention refers to a method of machining a thermosetting laminate, whereby said machining is a planing operation, such as an edge chamfering, an edge trimming, a jagging, a guttering, a grooving or the like. The planing is preferably an edge chamfering. The machining is performed by means of a high-frequency or ultrasonic planing machine having a planing tool consisting of at least one diamond or other material having a hardness according to Vickers of at least 1400–1600 kp/mm$^2$.

Thermosetting laminates are among other applications used as floor, wall, ceiling or furniture surfacing. Thermosetting laminates used in said application are normally produced in form of or cut into boards, plates, sheets, panels, bars and the like, whereby the laminate optionally is bonded to a carrier consisting of for instance fibre board, particle board, wood, plywood and similar materials. The boards, plates, sheets, etc. are then arranged side-by-side to a covering decorative and/or protective surface. The boards, plates, sheets, etc. are often or even normally machined to produce grooves, tenons, smooth edges, chamfers, jags, channels and the like. The edges of boards, plates, sheets, etc. are normally machined or tooled, using for instance a chamfering plane, to obtain smooth edges and smooth level crossing between boards, plates, sheets, etc. joint side-by-side. A smooth and plane level crossing increases substantially the abrasion resistance over the joint and decreases substantially damages and injuries to for instance an obtained surfacing and to objects, materials and persons coming into contact therewith.

Edge chamfering is normally carried out using a planing machine provided with a planing tool made for instance in a hard metal or metal alloy, such as steel or titanium. This kind of planing is less or not at all suitable for machining of materials such as thermosetting laminates. The hardness of the thermosetting laminates creates as well as emphasise a number of problems and negative effects, which can be summarised:

- rapid deterioration of the planing tool and thus tooling quality and accuracy as well as increased costs and decreased product quality,
- heavy heat release during tooling with pendant discoloration of the tooling zone,
- reduced or no possibility, due to the rapid tool deterioration and the heavy heat release, to increase the tooling speed or rate,
- large variations in the dimensions of the machined area including large variations in the size and angle of for instance a chamfer.

Chamfering of thermosetting laminates is per se a specific problem in. that the presently and normally machined chamfer of approximately 0.3–0.5 mm or even larger, with a deviation of ±0.1 mm or more, does not comply with a long standing customer demand for chamfers of approximately 0.1–0.2 mm or less. Accumulation of particles, dirt and other impurities, giving rise to for instance abnormal abrasion over the chamfer and hygienic problems, is one specific reason why reduced chamfer dimensions are required. The demand can neither be satisfied by conventional planing machines presently used nor by tools as disclosed above. It is from many reasons very difficult or impossible to produce, using conventional planing, cutting or milling machines, a chamfer being smaller than said 0.3–0.5 mm, which even that is difficult to obtain maintaining tooling quality and accuracy at high or at least acceptable levels.

Thermosetting laminates are well-known products used as instance as floor, wall, ceiling, furniture surfacing or as kitchen furnishings, whereby the laminate is decorative and/or protective. A thermosetting laminate most often comprises a core consisting of for instance Kraft paper impregnated with an epoxy resin or a phenol-formaldehyde resin, a monochromatic or patterned paper impregnated with a melamine-formaldehyde or urea-formaldehyde resin and optionally a so called overlay of α-cellulose impregnated with a melamine-formaldehyde resin. A number of these various papers in form for sheets or webs are laminated together under heat and pressure. Commonly used are also laminates bonded, such as glued, to a carrier consisting of for instance fibre board, particle board, wood, plywood and the like. The various paper sheets or webs, as disclosed above, can also be laminated and thus bonded directly to said carrier. Furthermore, the abrasion resistance of a thermosetting laminate can, as for instance disclosed in the European patent no. 0 329 154 (corresponding to U.S. Pat. No. 4,940,503), be increased by addition of hard particle, for instance aluminium oxide, when preparing for instance said overlay. An addition of hard particles makes discussed machining problems even more pronounced.

The present invention discloses a method of machining thermosetting laminates and eliminates or substantially reduces discussed problems and drawbacks. The machining is in preferred embodiments a planing operation carried out on a thermosetting laminate, which laminate preferably is used as a floor, wall, ceiling or furniture surfacing or as a kitchen furnishing, all in the form boards, plates, sheets, panels, bars and the like. The planing is in preferred embodiments an edge trimming, a jagging, a guttering, a grooving and in the most preferred embodiments an edge chamfering at an chamfer angle of 10–80° such as 30–60° resulting in a chamfer being less than 0.30 mm, preferably within the range of 0.05–0.20 mm. The planing is carried out by means of an apparatus comprising at least one high-frequency or ultrasonic oscillation generator and at least one dimension changing or adjusting unit having at least one piezoelectric crystal performing a linear vibration when charged with an alternating current. The linear vibration is propagated through at least one mechanical or electronic amplitude transforming unit, preferably comprising at least one mechanical booster, and the amplitude of generated high-frequency or ultra-sound, preferably having a frequency of 5–60 such as 10–40 or 15–25 kHz, is transformed into a linear vibration which during machining is propagated via at least one tiller or tool holder, such as a mandrel, connected to the amplitude changing unit. The tiller or tool holder is provided with at least one planing tool consisting of at least one diamond and at least said planing tool performs a linear horizontally and/or vertically oriented vibrating movement, whereby said planing tool executes said planing. The diamond is suitably attached to the tiller or tool holder, which in preferred embodiments is made of steel or titanium, by vacuum soldering. Normally and from a technical point of view preferably, said tiller or tool holder and said planing tool both perform said vibrating movement whereby only said planing tool is the machining member thereof.

The method of the present invention is primarily intended for machining of thermosetting laminates, but can also be used for similar machining of other materials being hard and/or difficult to machine, such as stone, concrete, ceramics and glassware.

Disclosed method and high frequency or ultrasonic apparatus and tool are cost saving in comparison to known rotating instruments, wherein machining is carried when a number of tools, such as 8, 16, 24 or more, made of steel, titanium, diamonds and the like are placed in a pre-determined order. Each tool carry, through the instrument rotation, out a pre-determined part of a machining sequence involving all in the instrument included tools. The apparatus used according to the method of the present invention requires in preferred embodiments only one tool executing the entire machining, whereby reducing costs as well as facilitating adjustment of the tool and thus increasing machining accuracy.

A thermosetting laminate, machined according to the method of the present invention, comprises at least one material, preferably a cellulose, a fibre-glass or a textile material, in form of a web, a sheet, threads or cut fibres. The material is impregnated with at least one thermosetting resin which under heat and/or pressure is fully cured. Preferred thermosetting resin can suitably be exemplified by resins such as polyester resins, epoxy resins, melamine-formaldehyde resins, urea-formaldehyde resins, phenol-formaldehyde resins as well as combinations thereof and therewith.

Preferred embodiments of the thermosetting laminates, machined according to the invention, comprise at least one core consisting of at least one Kraft paper web or sheet impregnated with at least one thermosetting resin, preferably an epoxy resin or a phenol-formaldehyde resin and/or at least one patterned or monochromatic paper web or sheet impregnated with at least one thermosetting resin, such as a melamine-formaldehyde and/or urea-formaldehyde resin. The thermosetting laminates can also suitably comprise at least one so called overlay consisting of or comprising at least one web or sheet of α-cellulose fibres impregnated with at least one thermosetting resin, preferably a urea-formaldehyde resin or a melamine-formaldehyde resin. Furthermore, said overlay and/or said patterned monochromatic paper sheets or webs can advantageously be surfaced with hard particles, such as aluminium oxide. Hard particles are added before, during or after impregnation, but before curing of the thermosetting resin. The various webs or sheets are finally stacked upon each other, in a pre-determined order and number, and are then laminated together under heat and pressure. Each thermosetting resin used for impregnation is individually partially or fully cured during said lamination.

The thermosetting laminates disclosed above can of course as most laminates be bonded to a carrier, which preferably consists of wood, fibre board, particle board, plywood or the like. The by lamination obtained laminate is whereby glued or by other means attached to said carrier. The various webs and sheets can alternatively be directly laminated, as above, under heat and pressure to the carrier. The thermosetting laminate is in these embodiments the member subjected to said machining.

The present invention provides a method of improved machining, wherein the improvements include:

- machining of hard materials, such as thermosetting laminates, stone, concrete, ceramics and glassware, without rapid deterioration of machining tools,
- improved tooling quality and accuracy with pendant decreased costs and increased product quality,
- no or substantially reduced heat release during machining and thus no or substantially reduced discoloration of the tooling zone,
- possibility to increase the tooling speed or rate without rapid tool deterioration and heavy heat release,
- small dimension deviations of the machined area and possibility to machine very small dimensions, such as chamfers being up to 60% smaller than presently and normally machined ones.

These and other objects and the attendant advantages will be more fully understood from the following detailed description, taken in conjunction with embodiment examples 1 an 2 and appended drawings, wherein like reference numerals have been applied like parts throughout the various figures.

Example 1: Edge chamfering at various target dimensions and various machining speeds.

Example 2: Abrasion over the chamfer at various chamfer dimensions.

FIG. 1: Shows schematically one embodiment of an apparatus comprising a chamfering tool used to carry out an edge chamfering in accordance with the method of the present invention.

Figure 2:
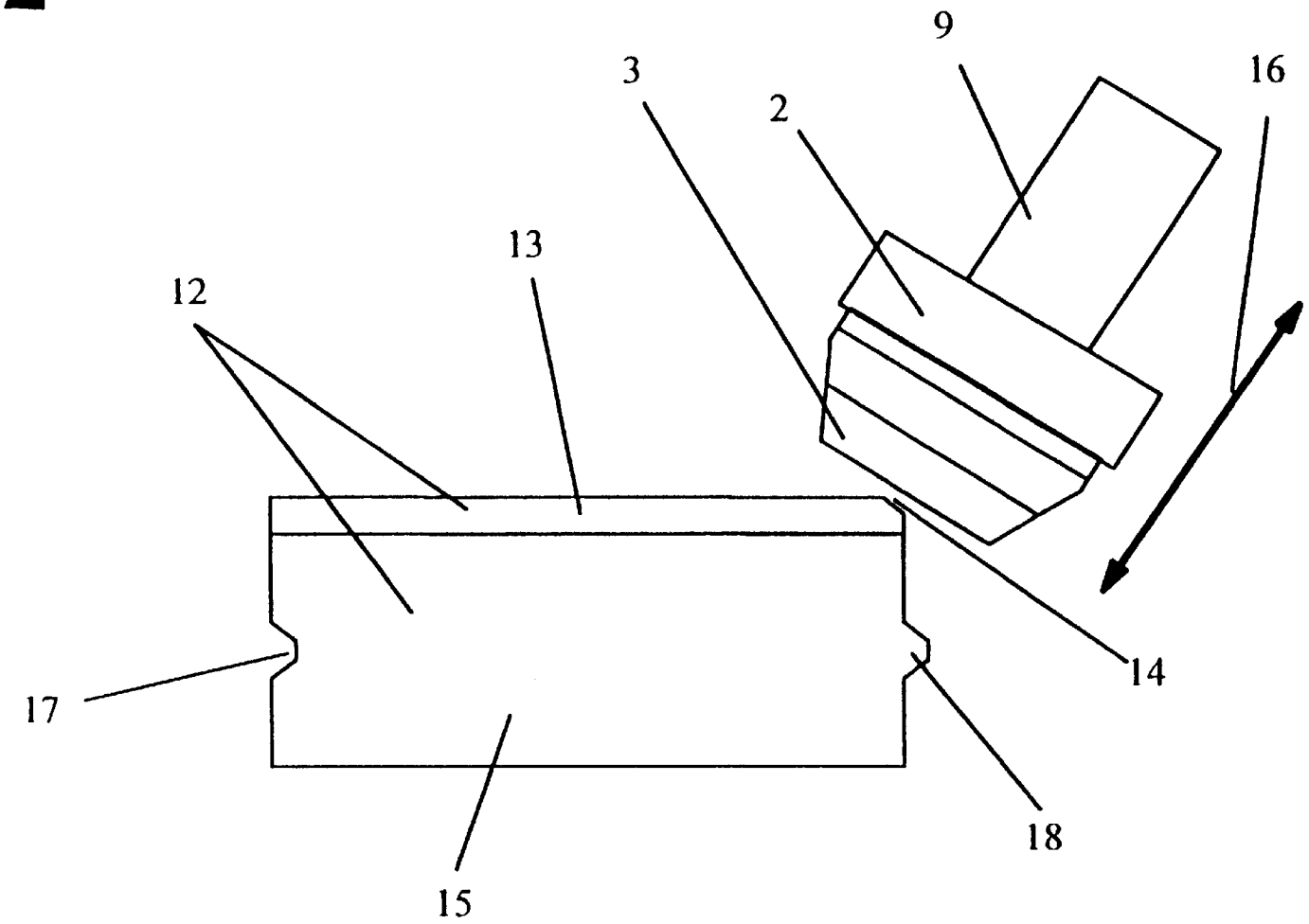

FIG. 2: Shows in a cut-out the chamfering tool of FIG. 1 during machining of a thermosetting laminate bonded to a carrier.

The various parts of FIGS. 1 and 2 are not entirely according to scale, some part are for reason of clarity and simplicity enlarged or reduced.

While particular embodiments of the invention will be shown, it will be understood, of course, that the invention is not limited thereto since many modifications may be made, and it is, therefore, contemplated to cover by the appended claims any such modifications as fall within the true spirit and scope of the invention.

EXAMPLE 1

Boards consisting of a thermosetting laminate glued onto a carrier of particle board were edge chamfered at three different target dimensions and three different machining speeds. An apparatus according to FIG. 1 was used to carried out said chamfering. Two boards were at each dimension and each speed chamfered and each chamfer were measured at four different positions ($C_1$–$C_4$). An average chamfer ($C_{av}$) and a standard deviation (σ) were from the four measurements calculated for each board. The chamfering were carried at an chamfer angle of 45° with the laminate pointing downwards. The boards were mechanically fed and kept at an invariable horizontal position. Used apparatus had a machining (feeding) speed of max. 50 m/minute.

Target dimensions and machining (feeding) speeds:

1. 0.07 mm–6.5 m/min.
2. 0.07 mm–21 m/min.
3. 0.10 mm–40 m/min.
4. 0.18 mm–6.5 m/min.

Obtained results are given in Tables 1–4 below.

TABLE 1

| | Target dimension: 0.07 mm Speed: 6.5 m/minute | | | | | |
|---|---|---|---|---|---|---|
| Board no. | $C_1$, mm | $C_2$, mm | $C_3$, mm | $C_4$, mm | $C_{av}$, mm | σ, mm |
| - 1 - | 0.07 | 0.08 | 0.07 | 0.07 | 0.0725 | 0.005 |
| - 2 - | 0.07 | 0.07 | 0.07 | 0.06 | 0.0675 | 0.005 |

TABLE 2

| | Target dimension: 0.07 mm Speed: 21 m/minute | | | | | |
|---|---|---|---|---|---|---|
| Board no. | $C_1$, mm | $C_2$, mm | $C_3$, mm | $C_4$, mm | $C_{av}$, mm | σ, mm |
| - 1 - | 0.05 | 0.05 | 0.06 | 0.05 | 0.0525 | 0.005 |
| - 2 - | 0.07 | 0.06 | 0.07 | 0.07 | 0.0675 | 0.005 |

TABLE 3

| | Target dimension: 0.10 mm Speed: 40 m/minute | | | | | |
|---|---|---|---|---|---|---|
| Board no. | $C_1$, mm | $C_2$, mm | $C_3$, mm | $C_4$, mm | $C_{av}$, mm | σ, mm |
| - 1 - | 0.10 | 0.10 | 0.08 | 0.10 | 0.0950 | 0.010 |
| - 2 - | 0.10 | 0.10 | 0.10 | 0.18 | 0.1050 | 0.010 |

TABLE 4

| | Target dimension: 0.18 mm Speed: 6.5 m/minute | | | | | |
|---|---|---|---|---|---|---|
| Board no. | $C_1$, mm | $C_2$, mm | $C_3$, mm | $C_4$, mm | $C_{av}$, mm | σ, mm |
| - 1 - | 0.20 | 0.17 | 0.19 | 0.17 | 0.1875 | 0.015 |
| - 2 - | 0.17 | 0.17 | 0.17 | 0.20 | 0.1775 | 0.015 |

The results show that a very small chamfer with an extremely small deviation in regard of its dimension can be obtained. A standard deviation of for instance 0.01 mm means that 85% of all chamfers are within ±0.01 mm of the target dimension. This is so small a deviation that it contrary to deviations, such as said ±0.1 mm, obtained using conventional planing or cutting machines and chamfer dimensions, such as said 0.3–0.5 mm, not is visual to the eye, not even on large areas such as floors, walls etc.

EXAMPLE 2

Boards obtained in accordance with Example 1 were joint to larger units, whereby the abrasion in and over the joints were evaluated by the commonly used Taber Abrasor Method (ISO 4586/2-88). A so called IP value (IP=Initial Point) for the initial abtasion is then obtained. The evaluation is carried out on the laminate side of the boards and over the joint between two boards. The difference in level between the various boards was in all evaluations measured to be 0.05 mm. Two evaluations at the chamfer dimensions 0.10 and 0.14 mm were carried out and compared with results obtained with conventionally chamfered boards having a chamfer dimension of 0.40 mm. The results are given in Table 5 below.

TABLE 5

| Chamfer, mm | Evaluation no. 1 IP value | Evaluation no. 2 IP value | Average IP value |
|---|---|---|---|
| 0.40 (ref.) | 17500 | 15000 | 16250 |
| 0.10 | 16500 | 14500 | 14500 |
| 0.14 | 18000 | 16500 | 16500 |

The results show that a reduction as high as 65–75% of the chamfer dimension has no or very little influence on the IP value and thus on the abrasion resistance over the joint. A substantially reduced chamfer dimension does thus not imply a reduced abrasion resistance in or over the chamfer or joint.

EXAMPLE 3

An ultrasonic planing machine having a planing tool made of titanium was compared with an apparatus in accordance with FIG. 1 and thus used according to the method of the present invention. A thermosetting laminate of the type disclosed in the European patent 0 329 154 (U.S. Pat. No. 4,940,503) was edge chamfered at an chamfer angle of 45°. The titanium tool was worn out, having deep recesses corresponding to the laminate edge in the tool, after only 6 meters of said edge chamfering. The planing tool used in accordance with the present invention and for edge chamfering of the same laminate, exhibited after 6000 meters of chamfering no signs of deterioration.

FIG. 1

FIG. 1 schematically shows one embodiment of an apparatus used to carried out the method of machining, in this case a planing operation, according to the present invention. The apparatus comprises a conventional high-frequency oscillation generator 1, a conventional dimension adjusting unit 4, a conventional amplitude transforming unit 5 and a planing tool 2. The dimension adjusting unit 4 comprises a piezoelectric crystal 8 and the amplitude transforming unit 5 a mechanical booster 6 to which a tiller/tool holder 7 in form of a mandrel 7' made of titanium is attached. The tool 2, comprises as machining member, a diamond 3, which is attached to the mandrel 7' by vacuum soldering. The piezoelectric crystal 8 executes when charged with an alternating current a linear vibration, which is propagated through the amplitude transforming unit 5 and thus the booster 6 and the mandrel 7'. The booster 6, depending on its design, changes generated high-frequency amplitude to a higher or lower level.

An electric alternating current (50 Hz-220 V) is supplied to the high-frequency oscillation generator 1 via a connection 10, whereby 20,000 Hz is transferred via a connection 11 to the dimension adjusting unit 4 and its piezoelectric crystal 8. A linear vibration is then propagated through the amplitude transforming unit 5 and its mechanical booster 6 and thus through the mandrel 7' attached thereto. The tool 2 and its machining member, the diamond 3, performs a linear vibrating movement, as indicated by arrow 16, whereby the tool 2 executes said planing operation.

FIG. 2

FIG. 2 shows planing i form of edge chamfering of a board 12, suitable used as floor board, consisting of a thermosetting laminate 13 glued onto a carrier 15 of particle board. The carrier 15 is provided with one groove 17 and one tenon 18 for joining two or more boards 12 to a larger area such as a floor surfacing. The thermosetting laminate 13 constitutes said board's upper surface and is subjected to edge chamfering by means of the apparatus shown in FIG. 1. The entire apparatus is not depicted, only its tool 2 and its machining member, a diamond 3. The tool 2 also comprises a tool connection 9 by which said tool 2 is connected to a mandrel 7' (see FIG. 1). The tool 2 performs a linear vibrating movement, as indicated by arrow 16, whereby said tool 2 executes said edge chamfering thus providing the thermosetting laminate 13 with an edge chamfer 14. The edge chamfering is performed at a chamfer angle of 45°.

What is claimed is:

1. A method for planing a thermosetting laminate, the planing being an edge chamfering of the thermosetting laminate carried out by means of an apparatus comprising at least one high-frequency or ultrasonic oscillation generator and at least one dimension changing or adjusting unit having at least one piezoelectric crystal performing a linear vibration when charged with an alternating current, the linear vibration being propagated through at least one amplitude transforming unit, whereby generated high-frequency or ultrasound is transformed into a linear vibration which during said edge chamfering is propagated via at least one tiller to at least one tool attached to said tiller, said tiller being connected to said amplitude changing unit and said tool comprising at least one diamond, charging the apparatus with electric current; and moving the tool including said diamond into contact with the thermosetting laminate to be edge chamfered, whereby at least said tool performs a linear vibrating movement planing said thermosetting laminate resulting in a chamfer of less than 0.30 mm.

2. The method according to claim 1, wherein the amplitude transforming unit is a mechanical amplitude transforming unit.

3. The method according to claim 1, wherein the amplitude transforming unit is an electronic amplitude transforming unit.

4. The method according to claim 1, wherein the amplitude transforming unit comprises at least one mechanical booster.

5. The method according to claim 1, wherein the tool holding tiller comprises at least one mandrel.

6. The method according to claim 1, wherein the high-frequency or ultrasound amplitude has a frequency of 5–60 kHz.

7. The method according to claim 6, wherein the frequency is 10–40 kHz.

8. The method according to claim 7, wherein the frequency is 15–25 kHz.

9. The method according to claim 1, wherein the chamfer is within a range of 0.05–0.20 mm.

10. The method according to claim 1, wherein the edge chamfering is carried out at a chamfer angle of 10–80°.

11. The method according to claim 10, wherein the chamfer angle is 30–60°.

12. The method according to claim 1, wherein the thermosetting laminate comprises at least one material in a form selected from the group consisting of a web, a sheet and cut fibers; the material being impregnated with at least one thermosetting resin which resin is fully cured under heat and pressure.

13. The method according to claim 12, wherein the material is selected from the group consisting of cellulose, glass fiber and textile.

14. The method according to claim 12, wherein the thermosetting resin is one selected from the group consisting of a polyester resin, an epoxy resin, a melamine-formaldehyde resin, a urea-formaldehyde resin, a phenol-formaldehyde resin and mixtures thereof.

15. The method according to claim 12, wherein the thermosetting laminate comprises at least one core consisting of at least one material selected from the group consisting of Kraft paper web and a Kraft paper sheet; said material being impregnated with at least one thermosetting resin.

16. The method according to claim 15, wherein the thermosetting resin is one selected from the group consisting of an epoxy resin and a phenol-formaldehyde resin.

17. The method according to claim 12, wherein the thermosetting laminate comprises at least one material selected from the group consisting of a patterned paper web, a monochromatic paper web, a patterned sheet and a monochromatic sheet impregnated with at least one thermosetting resin.

18. The method according to claim 17, wherein the thermosetting resin is one selected from the group consisting of a urea-formaldehyde resin and a melamine-formaldehyde resin.

19. The method according to claim 12, wherein the thermosetting laminate comprises at least one overlay, said overlay comprising at least one material selected from the group consisting of a web of α-cellulose fibers and a sheet of α-cellulose fibers; said overlay being impregnated with at least one thermosetting resin.

20. The method according to claim 19, wherein the thermosetting resin is one selected from the group consisting of a urea-formaldehyde resin and a melamine-formaldehyde resin.

21. The method according to claim 19, wherein the web or sheet is surfaced with hard particles after which the thermosetting resin is cured.

22. The method according to claims 21, wherein the hard particles are aluminum oxide particles.

23. The method according to claim 1, wherein the thermosetting laminate is bonded to a carrier, the carrier being selected from the group consisting of wood, fiber board, particle board and plywood and the thermosetting laminate being subjected to said edge chamfering.

24. The method according to claim 1, wherein the thermosetting laminate is a floor, wall, ceiling, furniture surfacing or kitchen furnishing, each in a form selected from the group consisting of a form of boards, plates, sheets and panels.

25. The method according to claim 23, wherein the carrier has at least one groove or tenon.

26. The method according to claim 24, wherein the carrier has at least one groove or tenon.

* * * * *